US005152112A

United States Patent [19]

Eustace

[11] Patent Number: 5,152,112

[45] Date of Patent: Oct. 6, 1992

[54] COMPOSITE GIRDER CONSTRUCTION AND METHOD OF MAKING SAME

[75] Inventor: Nicholas J. Eustace, Abbotsford, Canada

[73] Assignee: Iota Construction Ltd., Abbotsford, Canada

[21] Appl. No.: 557,772

[22] Filed: Jul. 26, 1990

[51] Int. Cl.[5] ..... E04C 3/36

[52] U.S. Cl. ..... 52/223 R; 52/334; 52/729; 52/743; 52/745

[58] Field of Search ..... 52/223 R, 272, 376, 52/86, 87, 733, 729, 730, 732, 743, 745, 334; 14/17, 16, 24, 73, 74

[56] References Cited

U.S. PATENT DOCUMENTS

| | | | |
|---|---|---|---|
| 3,368,016 | 2/1968 | Birguer | 52/223 R |
| 3,440,793 | 4/1969 | Zehnle | 52/723 |
| 3,577,504 | 5/1971 | Lipski | 52/723 |
| 3,611,665 | 10/1971 | O'Brien | 52/602 |
| 3,835,607 | 9/1974 | Raaber | 52/223 R |
| 4,006,523 | 2/1977 | Mauquoy | 52/223 R |
| 4,018,055 | 4/1977 | Le Clercq | 52/733 |
| 4,115,971 | 9/1978 | Varga | 52/334 |
| 4,196,558 | 4/1980 | Jungbluth | 52/334 |
| 4,493,177 | 1/1985 | Grossman | 52/334 |
| 4,571,913 | 2/1986 | Schleich et al. | 52/334 |
| 4,646,493 | 3/1987 | Grossman | 52/334 |
| 4,700,516 | 10/1987 | Grossman | 52/334 |
| 4,741,144 | 5/1988 | Graffin | 52/423 |

FOREIGN PATENT DOCUMENTS

| | | | |
|---|---|---|---|
| 105824 | 12/1938 | Australia | 52/86 |
| 893659 | 2/1944 | France | 52/372 |

*Primary Examiner*—James L. Ridgill, Jr.
*Attorney, Agent, or Firm*—John Russell Uren

[57] ABSTRACT

A girder comprises a web of reinforced concrete with steel plates attached to opposite sides of the web to form flanges which project from the web. The steel plates are attached to the web by means of studs. The web is cast in position between the plates to embed the studs therein. The girder is used in the construction of bridges.

15 Claims, 4 Drawing Sheets

COMPOSITE GIRDER CONSTRUCTION AND METHOD OF MAKING SAME

INTRODUCTION

This invention relates to a composite girder structure and to a method of manufacturing such a girder. The invention also extends to a structure, such as a bridge, incorporating the girder.

BACKGROUND OF THE INVENTION

Girders are commonly used in the construction of structures, such as bridges, to support vertical loads. The girders used are mainly of two types, i.e. girders which are entirely of steel and girders which are constructed entirely of reinforced concrete. In cross-section, the girders have a vertical central web portion and horizontal flanges at the opposite ends of the web portion. The concrete girders have the disadvantage that they require costly form systems to manufacture and prestressing by strands is usually necessary, which is expensive. Although the product is relatively cheap, it is heavy, and this results in high transportation costs, as well as high erection costs. Concrete beams can generally not be cantilevered. Steel girders, on the other hand, have the disadvantage that they are formed from an expensive raw material, otherwise, they have the advantage of being light, easy to erect and they can be cantilevered.

It is an object of the present invention to provide a girder which is a composite structure comprising both reinforced concrete and steel, thereby to minimize the disadvantages of the pure reinforced concrete and pure steel girders and yet to obtain the advantages of these two types of girders in a single structure.

SUMMARY OF THE INVENTION

According to the invention, there is provided a girder comprising a central web portion which is of a cast reinforced concrete material and having a pair of flanges on the opposite sides of the web portion which comprise steel plates which project on opposite sides of the web portion and each being secured to the web portion by means of a connector which projects from the steel plate into the web portion.

Also according to the invention, there is provided a method of manufacturing a girder comprising the steps of locating a pair of steel plates in parallel spaced relationship with respect to each other, the plates having connection members projecting from their mutually facing surfaces, and casting a concrete web portion between the steel plates to embed the connection members therein.

Further according to the invention, there is provided a bridge which comprises a pair of parallel spaced load-bearing girders, each of which comprises a central web portion which is of a cast reinforced concrete material and having a pair of flanges on the opposite sides of the web portion which comprise steel plates which project on opposite sides of the web portion and each being secured to the web portion by means of a connector which projects from the steel plate into the web portion.

The intention has been to develop a hybrid design which combines selected advantages of conventional reinforced concrete, prestressed concrete and structural steel girders, in such a way that fabrication can be carried out without specialized facilities using straightforward and readily available construction techniques. The result is a more cost effective form of construction for many typical structural applications.

Further objects and advantages of the invention will become apparent from the description of a preferred embodiment of the invention below.

BRIEF DESCRIPTION OF DRAWINGS

The invention will now be described, by way of examples, with reference to the accompanying drawings, in which.

DESCRIPTION OF PREFERRED EMBODIMENT

Figure 1:
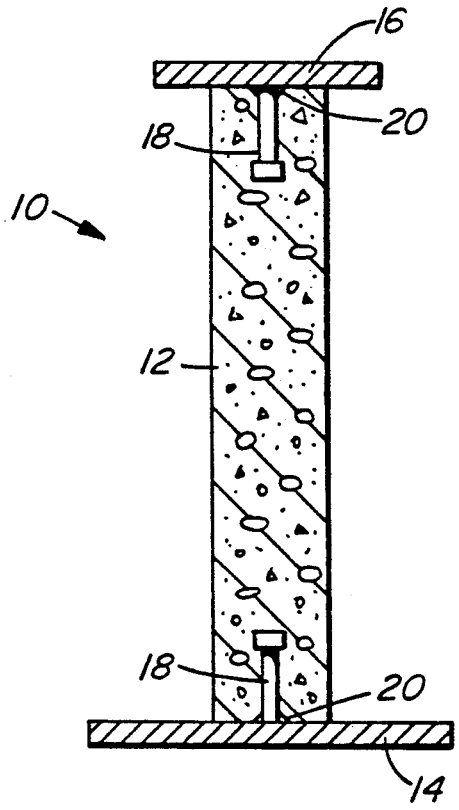
FIG. 1 is a cross-section through a girder or I-beam according to one embodiment of the invention.

With reference to FIG. 1, reference numeral 10 generally indicates a girder comprising a web portion 12 of reinforced concrete and having an elongate steel plate 14 attached along one side thereof and an elongate steel plate 16 attached along the other side thereof. The steel plates 14, 16 project on opposite sides of the web portion 12 to form flanges. The plate 14, in this particular embodiment, is wider than the plate 16. The plates 14, 16 are attached to the web portion 12 by means of shear connector studs 18 which are welded to the steel plates 14, 16 as shown at 20.

Figure 2:
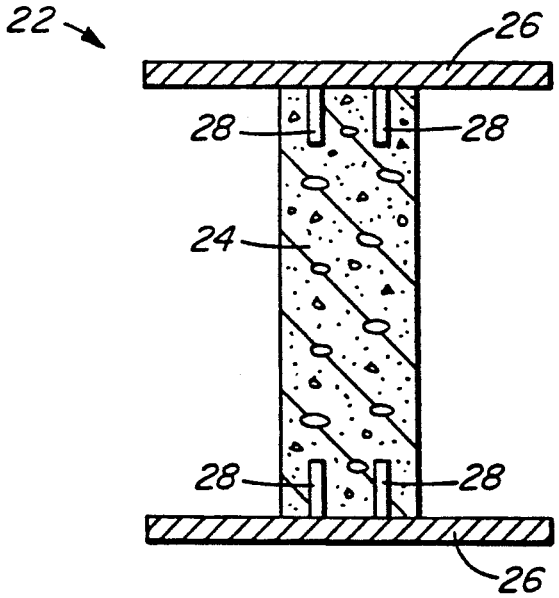
FIG. 2 is a cross-section through a girder according to another embodiment of the invention.

With reference to FIG. 2, a girder 22 according to another embodiment of the invention is shown. The girder 22 comprises a web portion 24 of reinforced concrete and a pair of elongate steel plates 26 attached along the opposite sides of the web 24 by means of two rows of studs 28, instead of a single row, as in FIG. 1. In this case the plates 26 on the opposite sides of the web 24 are of equal width.

It will be appreciated that composite girders of various different sizes and shapes, to suit different requirements, can be provided. For example, the width and thickness of the steel plates can be varied to suit the requirements of different bridges for which the girders, according to the invention, may be used. Also, the number of rows of studs, the number of studs in a row, and the length and type of studs used will depend on a particular application and requirements. Similarly, the width, height and reinforcing of the concrete web can be varied to suit different requirements.

Figure 3:
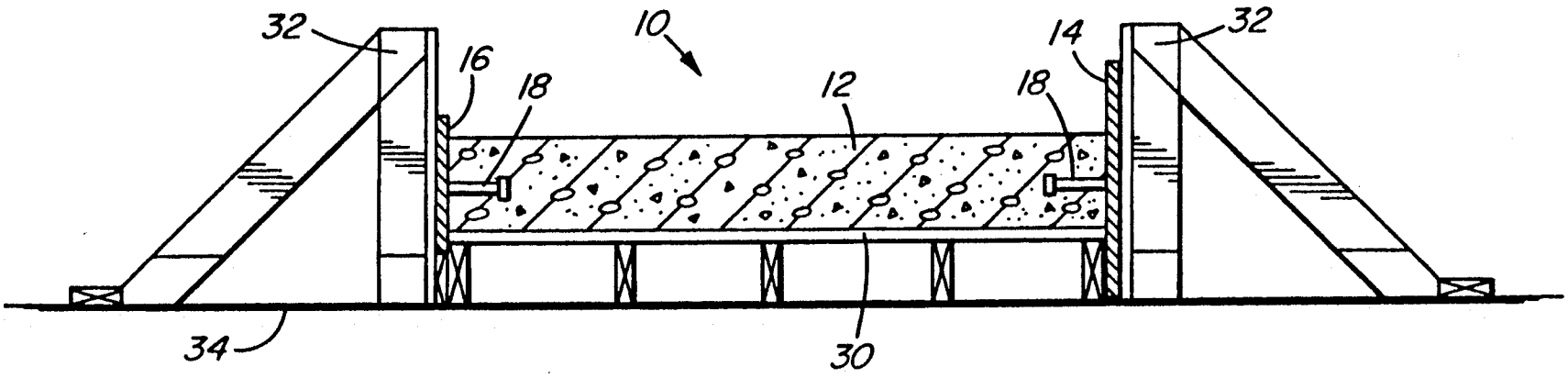
FIG. 3 is a cross-sectional view of a casting installation for manufacturing the girder of FIG. 1.

With reference to FIG. 3, a method of manufacturing the girder 10 of FIG. 1 is shown.

Firstly, a bottom falsework 30 and end forms 32 are installed on a casting bed 34. The steel plates 14 and 16 are then laid on edge in parallel spaced relationship, with the studs 18 welded in position, as shown. At this stage, the desired reinforcing steel bars and/or post-tension or pre-tension cables are installed, as required. The reinforcing bars and post-tension or pre-tension cables are not shown in FIG. 3. Thereafter, concrete is cast into the space between the plates 14 and 16, the bottom falsework 30 providing a raised temporary surface for supporting the concrete. The concrete is cast to the desired height to form the web 12, as shown. Once the concrete has set, the girder 10 can be removed from the falsework 30 and end forms 32.

In this example, the girder 10 has been described as being cast in a horizontal position. However, if desired, the girder 10 can also be cast in a vertical position.

Figure 4:
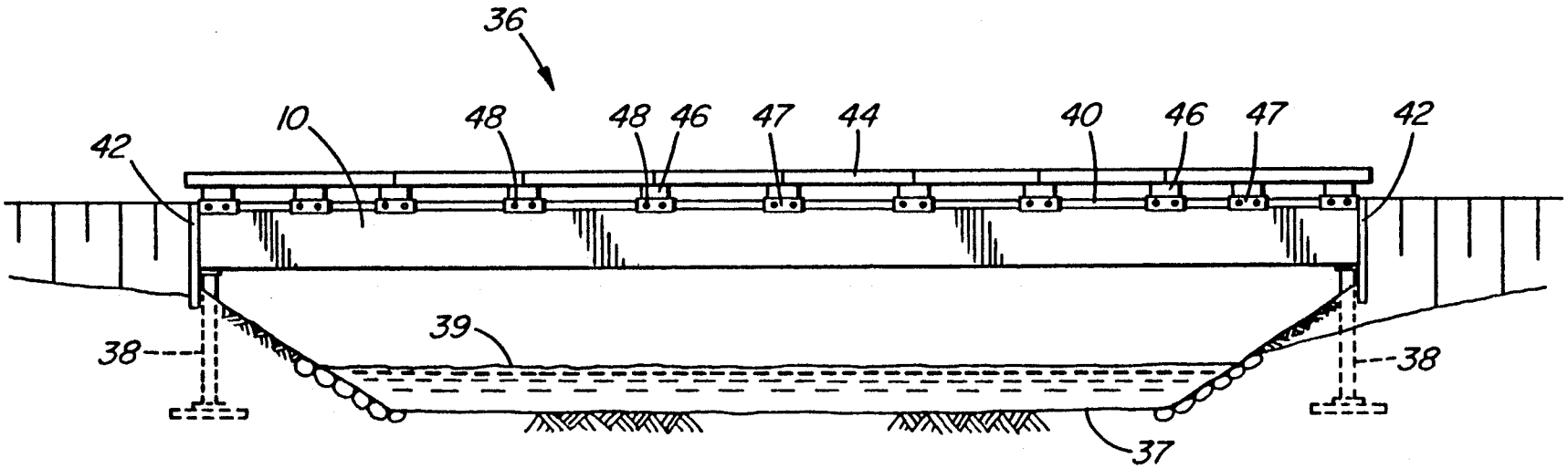
FIG. 4 is a side view of a logging bridge incorporating the girder of FIG. 1.
Figure 5:
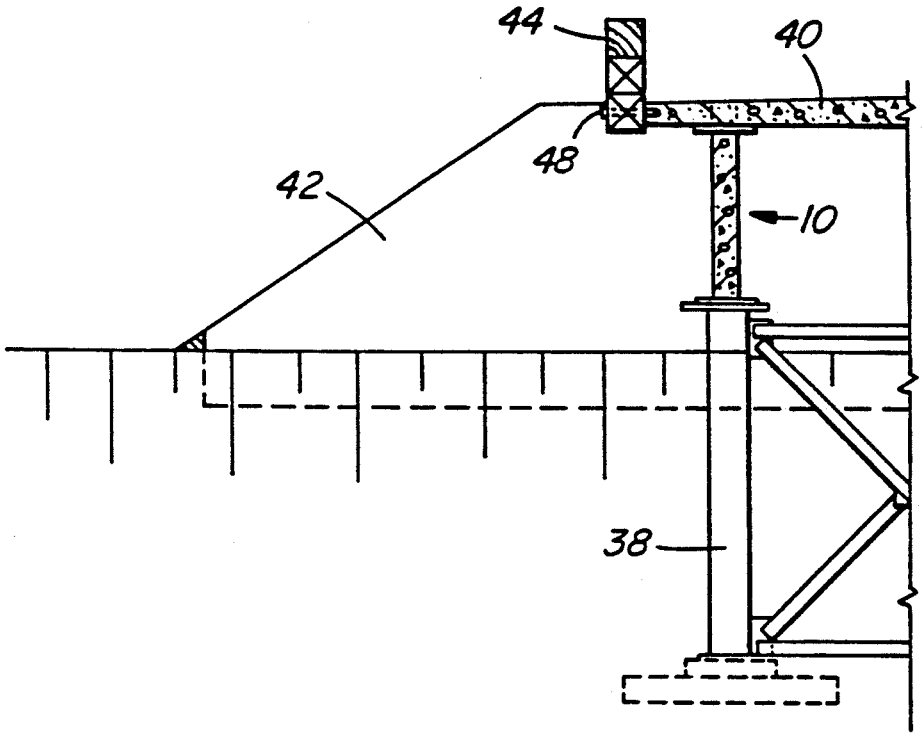
FIG. 5 is a partial end view, partially in cross-section and on a larger scale, of the bridge of FIG. 4.

With reference to FIGS. 4 and 5, a logging bridge 36 incorporating a pair of the girders 10 is shown. The girders 10 are laid in parallel spaced relationship over a stream bed 37 and are supported at their opposite ends by end supports 38. The water line is indicated by reference numeral 39. A precast concrete deck panel 40 is laid onto and is supported by the girders 10 spanning the stream bed 37. A ballast wall 42 is provided at each of the opposite ends of the bridge 36. The bridge 36 is provided with a timber guard rail 44 along each of its opposite sides which is supported by timber riser blocks 46 which are located on timber base blocks 47 which in turn are bolted to the concrete deck 40 by means of bolts 48.

While the girder according to the invention is being described in the present example as being used as beams in a logging bridge, it is not limited to such use and it can be used in other types of bridges, such as interstate highway bridges, municipal bridges, as well as off-road bridges, such as mining and forestry bridges. Its use as heavy load capacity beams in other structural applications is also possible.

The girder according to the invention can be manufactured in one piece to reach a required span by providing adequate reinforcing in the concrete or, as an alternative, or, in addition, pre-tensioning or post-tensioning the concrete to meet the load bearing demands to which the girder may be subjected.

While only preferred embodiments of the invention have been described herein in detail, the invention is not limited thereby and modifications can be made within the scope of the attached claims.

What is claimed is:

1. A girder comprising a central web portion and having a pair of flanges on the opposite sides of said web portion which are of steel plates, said web portion being of a cast reinforced concrete material and having a height dimension between said flanges and a width dimension transverse to said height dimension, said height dimension being substantially greater than the dimension of each of said flanges, each of said flanges projecting beyond the width of said web portion where said web portion joins each of said flanges, each flange being secured to said web portion by means of a connector which projects from the steel plate into said web portion.

2. A method of constructing a bridge comprising the steps of forming a pair of girders according to claim 1, each being of a length sufficient to span a void between opposing banks and installing the girders in parallel spaced relationship between the banks.

3. A method of constructing a bridge comprising the step of laying a pair of girders according to claim 1 in parallel spaced relationship across an expanse to serve as load bearing members for supporting the bridge.

4. A building structure incorporating a girder according to claim 1 therein.

5. A bridge incorporating a girder according to claim 1 therein.

6. The girder according to claim 1, wherein the connector comprises a stud which is welded to the steel plate.

7. The girder according to claim 6, wherein a plurality of said studs are provided which are spaced along the length of each steel plate.

8. The girder according to claim 7, wherein the concrete is pre-stressed.

9. The girder according to claim 6, wherein the concrete is post-stressed.

10. A method of manufacturing a composite concrete and steel girder comprising the steps of locating a pair of steel plates in parallel spaced relationship with respect to each other, positioning connection members of said plates such that said connection member project from their mutually facing surfaces and casting a concrete web portion between the steel plates to embed the connection members therein, and with the steel plates projecting beyond the width of the web portion where said concrete web portion joins said steel plates, said steel plates forming flanges.

11. The method according to claim 10, wherein said steel plates are formed in an elongate shape and wherein the connection members are spaced along the length of each plate.

12. The method according to claim 11, and further comprising locations with their long dimensions horizontally and casting the web portion on a raised horizontal falsework surface provided between the plates.

13. The method according to claim 12, further including the step of installing reinforcing steel bars between the plates prior to casting the concrete.

14. The method according to claim 12, further including the step of installing post-tension cables between the plates prior to casting the concrete.

15. The method according to claim 12, further including the step of installing pre-tension cables and tensioning the cables prior to casting the concrete.

* * * * *